US005156094A

United States Patent [19]

Johansson et al.

[11] Patent Number: 5,156,094

[45] Date of Patent: Oct. 20, 1992

[54] LOAD-CARRYING PALLET OF CORRUGATED CARDBOARD

[75] Inventors: Bengt Johansson, Älmhult; Jan Helgesson, Osby, both of Sweden

[73] Assignee: Inter-Ikea A/S, Denmark

[21] Appl. No.: 732,339

[22] Filed: Jul. 17, 1991

Related U.S. Application Data

[63] Continuation of Ser. No. 163,261, Mar. 2, 1988, abandoned.

[30] Foreign Application Priority Data

Mar. 17, 1987 [DK] Denmark ..... 1370/87

[51] Int. Cl.[5] ..... B65D 19/00

[52] U.S. Cl. ..... 108/51.3; 108/51.1

[58] Field of Search ..... 108/51.3, 901, 51.1; 206/599, 586; 229/DIG. 1

[56] References Cited

U.S. PATENT DOCUMENTS

| | | | |
|---|---|---|---|
| 2,068,771 | 1/1937 | Sherman | 229/DIG. 1 X |
| 2,432,295 | 12/1947 | Donahue | 108/51.3 X |
| 2,444,183 | 6/1948 | Cahners | 108/51.3 |
| 2,501,506 | 3/1950 | George | 108/51.3 |
| 3,861,326 | 1/1975 | Brown | 108/901 X |

FOREIGN PATENT DOCUMENTS

| | | | |
|---|---|---|---|
| 2490187 | 3/1982 | France | 108/51.3 |
| 695248 | 8/1953 | United Kingdom | 108/51.3 |
| 697232 | 9/1953 | United Kingdom | 108/51.3 |
| 1144715 | 3/1969 | United Kingdom | 108/901 |

*Primary Examiner*—Peter A. Aschenbrenner

[57] ABSTRACT

A disposable pallet comprises a base plate of corrugated cardboard and a plurality of block-shaped feet situated on the bottom side of the base plate. Each block-shaped foot is made of a strong corrugated cardboard and is substantially solid, said foot comprising a substantially planar laminate including at least ten layers of corrugated cardboard situated substantially perpendicular to the base plate. Compared to the main dimension of the base plate the block-shaped foot is of a relatively small height of 15–35 mm. The pallet is very simple and strong and furthermore very inexpensive.

1 Claim, 2 Drawing Sheets

LOAD-CARRYING PALLET OF CORRUGATED CARDBOARD

This application is a continuation of application Ser. No. 07/163,261, filed Mar. 2, 1988.

FIELD OF THE INVENTION

The invention relates to a pallet, preferably a disposable pallet of the type comprising a base plate of corrugated cardboard and a plurality of block-shaped feet also of corrugated cardboard and situated on the bottom side of the base plate.

BACKGROUND ART

It has been known for a long time to manufacture pallets of corrugated cardboard. Thus the U.S. Pat. No. 3,763,791 discloses a pallet comprising block-shaped feet formed by small box-shaped bodies of corrugated cardboard, the walls of said bodies including two layers of corrugated cardboard. The box-shaped bodies comprise projecting webs of corrugated cardboard, said webs allowing a securing of the bodies to the bottom side of the pallet base plate. These webs extend upwards through slots in the base plate and are bent on the top side of the base plate. Furthermore these block-shaped feet are rather high. The latter two features imply that this pallet is not quite satisfactory because a large inner cavity in the block-shaped foot makes said foot rather weak. As the block-shaped feet are rather high they can work loose relatively easily from the base plate in case said base plate is subjected to a strong horizontal effect when the pallet is loaded with articles while situated on the ground. A further disadvantage of this known pallet is that it is rather complicated.

SUMMARY OF THE INVENTION

The object of the present invention is to provide a pallet of the above type which is simpler and stronger than the previously known pallets, and which in addition is very compact.

To be compact is a very important feature because many pallets with articles piled thereon must be pileable atop one another in small compartments, such as in a container or a truck where the compartment is utilized to a maximum, i.e. including as little air as possible. This compact feature must be ensured at the same time as a safe handling of the pallets by means of a fork truck must be possible in an easy manner.

The pallet according to the invention is characterised in that each block-shaped foot is made of a strong corrugated cardboard and is substantially solid, each foot comprising a substantially planar laminate including at least ten layers of corrugated cardboard situated substantially perpendicular to the base plate, and that the block-shaped foot is of a relatively small height of 15–35 mm compared to the main dimension of the base plate. As a result the pallet is extremely simple and strong and furthermore very inexpensive. The strength is ensured by the block-shaped feet comprising no weak interior. A single laminate including only a few layers of corrugated cardboard does not suffize. The laminate must include at least ten layers. As the block-shaped feet are very low on account of the large number of layers of corrugated cardboard and furthermore very broad, no risk exists of said feet working loose from the base plate at a lateral effect on the pallet when said pallet is being loaded with articles. Furthermore the pallet is very suited for transporting articles in containers or truck compartments where the compartments must be utilized to a maximum, and where a loading and unloading of the pallets by means of a fork truck is simultaneously desired. The very simple structure of the pallet ensures a particularly inexpensive manufacturing price, which allows a discarding of the pallet, said pallet thereby being a disposable pallet.

An embodiment of the pallet according to the invention is characterised in that the corrugated cardboard used for the laminate of the block-shaped feet is of a type of a weight in the range 140–180 g/m$^2$, preferably 160 g/m$^2$. As a result the pallet is provided with a suitable strength.

Furthermore according to the invention at least part of the pallet, preferably the block-shaped feet, is coated and/or impregnated with a water-repellent agent such as wax or plastics. As a result the pallet is stronger in a very simple manner than the known pallets even in case it is exposed to moisture because said moisture cannot weaken the block-shaped feet.

One or more very thin layers of plastic foam, preferably polyvinyl chloride may according to the invention form part of the laminate of the block-shaped feet, whereby each block-shaped foot is strengthened considerably.

According to the invention the laminated block-shaped feet may be glued onto the base plate by means of a single-component latex glue, which shortens the production time of the pallet.

According to the invention the small grooves of each layer of corrugated cardboard in each block-shaped foot may extend perpendicular to the base plate, whereby the carrying capacity of the foot is increased.

Moreover according to the invention the bottom side of the block-shaped feet may be covered by a cover face of for instance cardboard or corrugated cardboard, whereby it is ensured that water cannot by a capillary effect penetrate the small grooves in the vertical layers of corrugated cardboard. The maximum sectional dimension of these small grooves is about 4–5 mm.

Furthermore according to the invention one or more thin metal wires may extend around each block-shaped foot so as to hold together the layers of corrugated cardboard when said layers are loaded. As a result the layers of corrugated cardboard of each block-shaped foot are prevented from being pressed aside at great vertical loads. Consequently the block-shaped feet are considerably strengthened.

Finally according to the invention the layers of corrugated cardboard in each block-shaped foot may be crossed, the small grooves of each layer of corrugated cardboard being situated substantially perpendicular to the small grooves of the neighboring layer of corrugated cardboard.

BRIEF DESCRIPTION OF DRAWINGS

The invention will be described below with reference to the accompanying drawings, in which.

DESCRIPTION OF PREFERRED EMBODIMENTS

Figure 1:
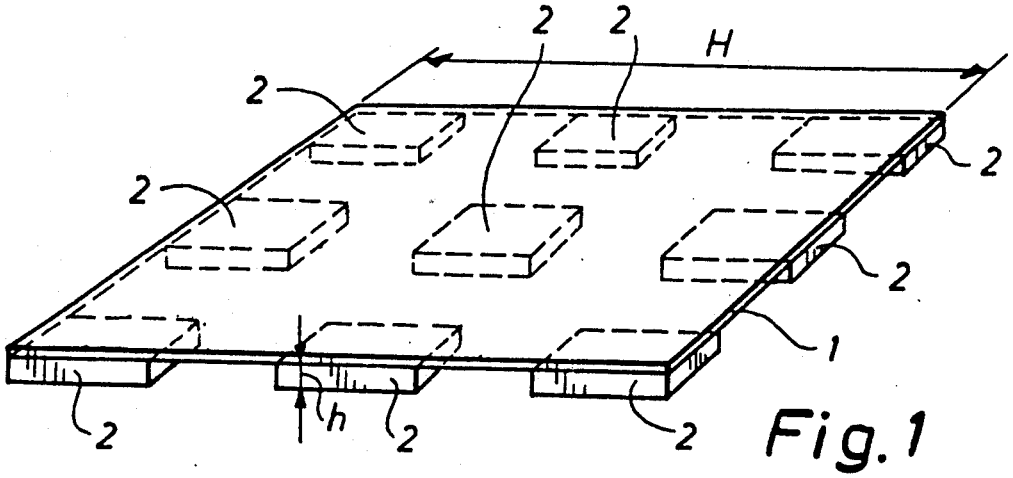
FIG. 1 is a perspective view of a pallet according to the invention, where the very low block-shaped feet of the pallet are situated on the bottom side of the pallet base plate and appear clearly.

The pallet of FIG. 1 is preferably a disposable pallet and comprises a base plate 1 of corrugated cardboard and a plurality of block-shaped feet 2 situated on the bottom side of the base plate. These feet are also made of corrugated cardboard. The base plate 1 comprises preferably a horizontal layer of corrugated cardboard, but may also comprise two or three such layers. Each block-shaped foot 2 comprises a substantially planar laminate, cf. FIG. 2, which includes at least ten layers of corrugated cardboard 3*a*, 3*b*, 3*c* . . . situated substantially perpendicular to the base plate 1. The block-shaped foot is substantially solid because no large cavities exist in the interior thereof. The corrugated cardboard used is of a strong type. The height h of each block-shaped foot is relatively small compared to the main dimension H of the pallet and is in the range 15–35 mm. Thus the block-shaped foot is very low which is an extremenely important feature because the pallet and the articles piled thereon must take up as little space as possible when stored in for instance a container or a truck compartment. However, the block-shaped feet must be just so high that the forks of a fork truck can slip beneath the pallet so as to lift and handle said pallet.

Usually the corrugated cardboard used is of the type "one-sided well" of a weight in the range 140–180 g/m$^2$, preferably 160 g/m$^2$.

In order to increase the resistance of the block-shaped feet to moisture, they may be coated and/or impregnated with a water-repellant agent, such as wax or plastics, preferably polyvinyl chloride.

Figure 3:
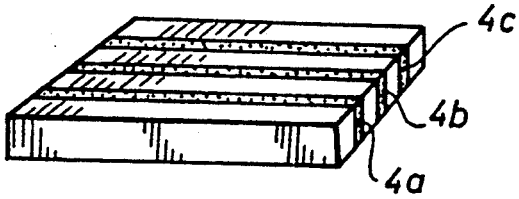
FIG. 3 illustrates a second embodiment of a block-shaped foot including a layer of plastic foam between the layers of corrugated cardboard.

As illustrated in FIG. 3, the corrugated cardboard laminate of each block-shaped foot 2 may include one or more very thin layers of plastic foam as indicated for instance at 4*a*, 4*b*, and 4*c*. These layers have a blocking effect and increase the resistance to compression of the block-shaped foot.

Each block-shaped foot 2 is preferably glued onto the base plate 1 by means of a single-component latex glue.

Figure 2:
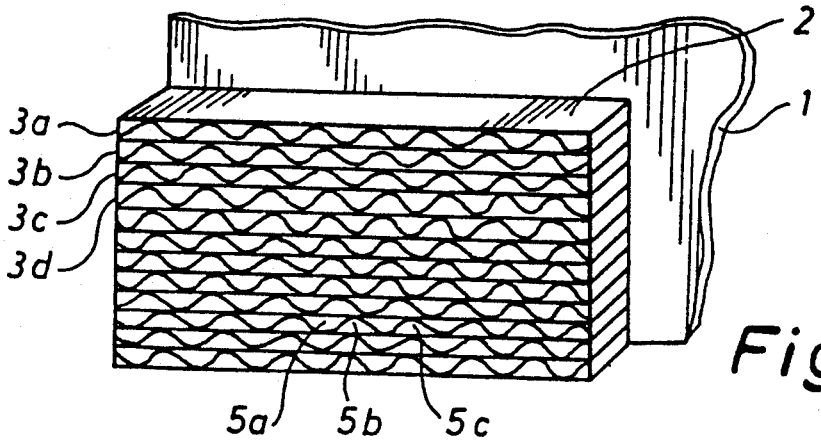
FIG. 2 is an inclined bottom view of a block-shaped foot.

FIG. 2 is, as mentioned, an inclined bottom view of a block-shaped foot. It is noted that the small grooves 5*a*, 5*b*, 5*c* of each layer of corrugated cardboard preferably extend perpendicular to the base plate 1.

Figure 4:
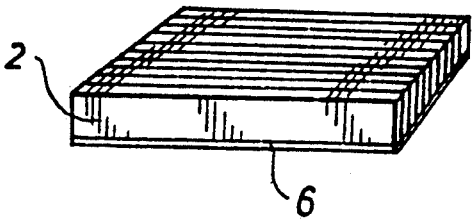
FIG. 4 illustrates a third embodiment of a block-shaped foot, where the bottom side of said foot is provided with a horizontal layer of corrugated cardboard.

As illustrated in FIG. 4, the bottom side of each block-shaped foot 2 may be covered by a cover face 6 of for instance cardboard or corrugated cardboard, whereby moisture to a certain degree is prevented from seeping upwards into the small grooves 5*a*, 5*b*, 5*c*, cf. FIG. 2, of the foot.

Figure 5:
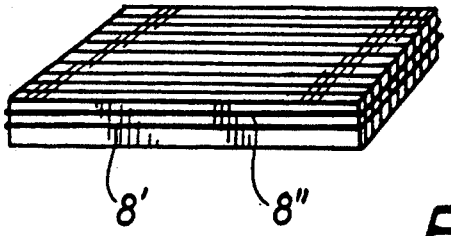
FIG. 5 illustrates a fourth embodiment of a block-shaped foot, where one or more circumferential metal wires are provided for holding together and strengthening all the layers of corrugated cardboard.
Figure 6:
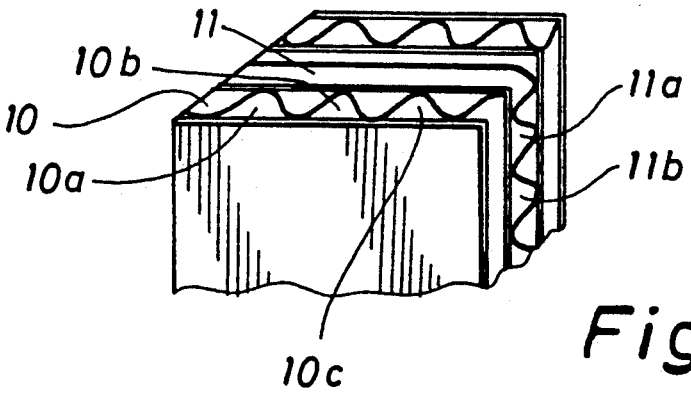
FIG. 6 illustrates a portion of a block-shaped foot comprising crossed layers of corrugated cardboard.

As illustrated in FIG. 5 one or more thin metal wires 8′, 8″ may extend around each block-shaped foot 2 so as to increase the resistance to compression of the foot. The metal wires may optionally also extend between two succeeding layers of corrugated cardboard in the interior of the bock-shaped foot. The invention may be varied in many ways without deviating from the scope thereof. Thus the layers of corrugated cardboard of each block-shaped foot 2 may be crossed, cf. FIG. 6, whereby the small grooves 10*a*, 10*b*, 10*c* of the layer 10 are situated substantially perpendicular to the small grooves 11*a*, 11*b* of the layer 11.

We claim:

1. A pallet comprising a base plate of corrugated cardboard and having a plane bottom surface, and a plurality of feet of corrugated cardboard glued onto said plane bottom surface, the feet are glued onto the base plate with a single-component latex glue, each foot being a substantially solid, planar laminate including at least ten layers of corrugated cardboard extending substantially perpendicular to the base plate, said corrugated cardboard having vertical layers with small grooves wherein said small grooves have a maximum sectional diameter of about 4–5 mm, small grooves of each layer of corrugated cardboard in each foot extend perpendicular to the base plate, each foot being of relatively small height perpendicular to said bottom surface, 15–35 mm, compared to the dimension of the base plate and compared to the length and width of each foot, each foot having a block shape and being substantially solid with no large cavities within therein, the corrugated cardboard of the laminate is of a weight in the range 140–180 g/m$^2$, at least part of the pallet is coated and/or impregnated with a water-repellant agent, at least one very thin layer of plastic foam forms part of the laminate, each foot has a cover face of cardboard or corrugated cardboard on a side remote from the bottom surface of the base plate, at least one metal wire extends around each foot so as to hold together the layers of corrugated cardboard when said layers are loaded, small grooves of each layer of corrugated cardboard are situated substantially perpendicular to the small grooves of the neighboring layer of corrugated cardboard and metal wires extend between two succeeding layers of corrugated cardboard in the interior of the block-shaped foot.

* * * * *